US007396297B2

(12) United States Patent
Hirano

(10) Patent No.: US 7,396,297 B2
(45) Date of Patent: Jul. 8, 2008

(54) GOLF CLUB HEAD

(75) Inventor: Tomoya Hirano, Kobe (JP)

(73) Assignee: SRI Sports Limited, Kobe-shi Hyogo (JP)

( * ) Notice: Subject to any disclaimer, the term of this patent is extended or adjusted under 35 U.S.C. 154(b) by 60 days.

(21) Appl. No.: 11/540,677

(22) Filed: Oct. 2, 2006

(65) Prior Publication Data

US 2007/0105656 A1 May 10, 2007

(30) Foreign Application Priority Data

Nov. 4, 2005 (JP) ..... 2005-321194

(51) Int. Cl.
*A63B 53/04* (2006.01)

(52) U.S. Cl. ..... 473/345; 473/349

(58) Field of Classification Search ..... None
See application file for complete search history.

(56) References Cited

U.S. PATENT DOCUMENTS 5,232,224 A * 8/1993 Zeider ..... 473/345
6,099,414 A * 8/2000 Kusano et al. ..... 473/342
6,334,817 B1 * 1/2002 Ezawa et al. ..... 473/324
6,966,848 B2 11/2005 Kusumoto et al.
7,108,614 B2 * 9/2006 Lo ..... 473/345
7,175,541 B2 * 2/2007 Lo ..... 473/345
7,278,925 B2 * 10/2007 Oyama ..... 473/329
2002/0094880 A1 * 7/2002 McCabe ..... 473/305
2003/0087709 A1 * 5/2003 McCabe ..... 473/305
2004/0083596 A1 * 5/2004 Willett et al. ..... 29/557
2005/0090331 A1 * 4/2005 Oyama ..... 473/345

* cited by examiner

*Primary Examiner*—Alvin A. Hunter, Jr.
(74) *Attorney, Agent, or Firm*—Birch, Stewart, Kolasch & Birch, LLP

(57) ABSTRACT

A hollow golf club head comprises a face portion whose front face defines a club face for striking a golf ball, a crown portion intersecting the club face at the upper edge thereof, and a sole portion intersecting the club face at the lower edge thereof, wherein at least one of the crown portion or the sole portion is made of a rolled steel at least partially, and a rolling direction of the rolled steel is in the range of from 0 to 20 degrees with respect to a front-back direction of the head.

6 Claims, 14 Drawing Sheets

GOLF CLUB HEAD

BACKGROUND OF THE INVENTION

1. Technical Field

The present invention relates to a golf club head which can improve its durability and the repulsion performance.

2. Background Art

A hollow golf club head with a face portion made of rolled steel is proposed. The face portion normally includes a center part having a great thickness and a peripheral part having a smaller thickness. The club head mentioned above improves a repulsion performance without deteriorating strength of the face portion.

As a result of various experiments, the inventors of the present invention have found that a durability, a repulsion performance and a ball hitting feeling of a club head can be improved by using a rolled steel having the rolling direction along a front-back direction of the head in at least a part of a crown portion or a sole portion of a hollow golf club head.

SUMMARY OF THE INVENTION

As mentioned above, a main object of the present invention is to provide a hollow golf club head which can achieve an improvement in the durability, the repulsion performance and the ball hitting feeling.

According to the present invention, a hollow golf club head comprises a face portion whose front face defines a club face for striking a golf ball, a crown portion intersecting the club face at the upper edge thereof, and a sole portion intersecting the club face at the lower edge thereof, wherein at least a part of the crown portion or at least a part of the sole portion is made-of a rolled steel, and a rolling direction of the rolled steel is in the range of from 0 to 20 degrees with respect to a front-back direction of the head.

DESCRIPTION OF THE PREFERRED EMBODIMENTS

Embodiments of the present invention will now be described in detail in conjunction with the accompanying drawings.

Figure 1:
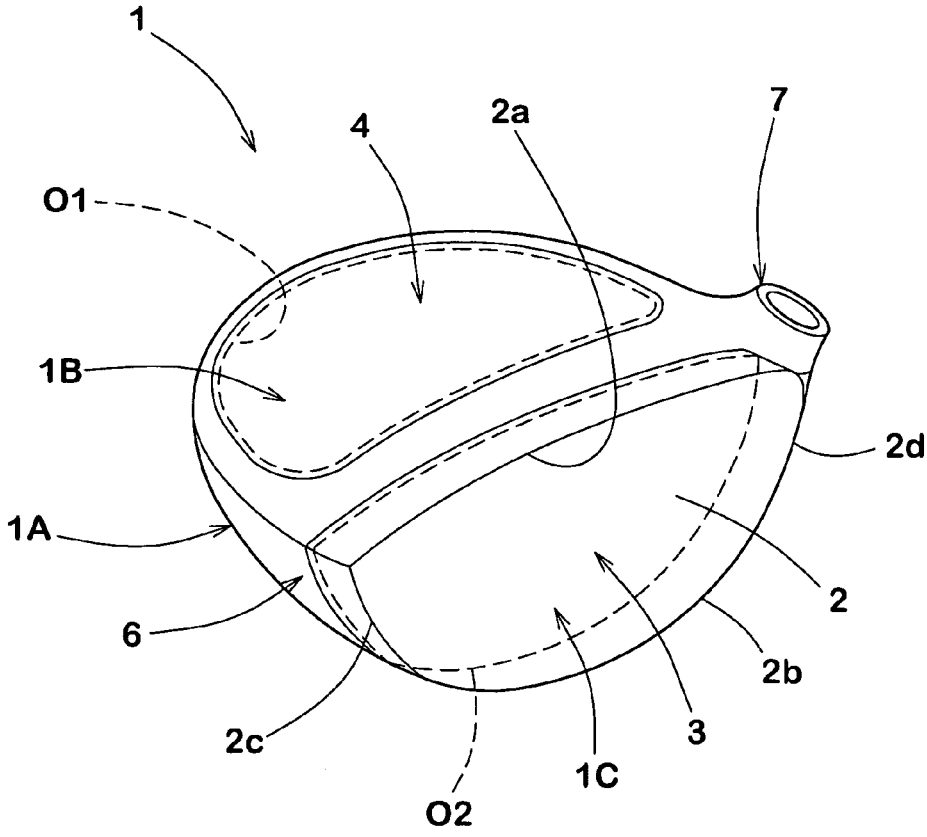
FIG. 1 is a perspective view of a golf club head according to the present embodiment.
Figure 2:
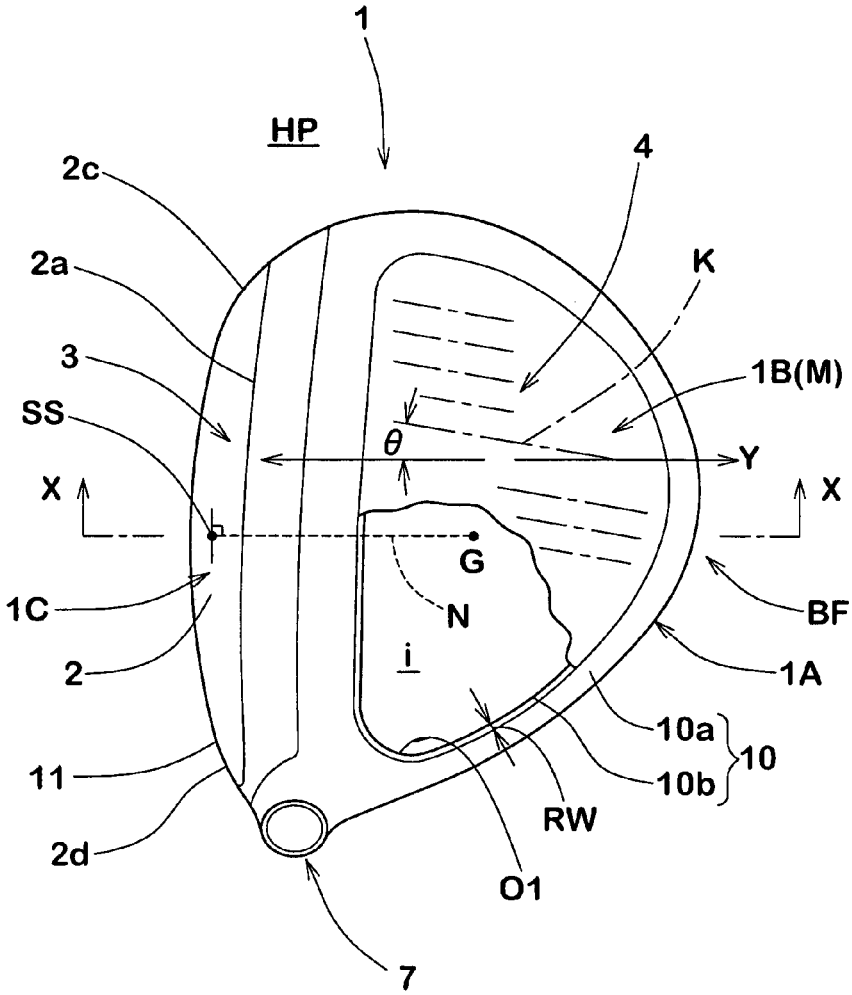
FIG. 2 is a plan view of the golf club head.
Figure 3:
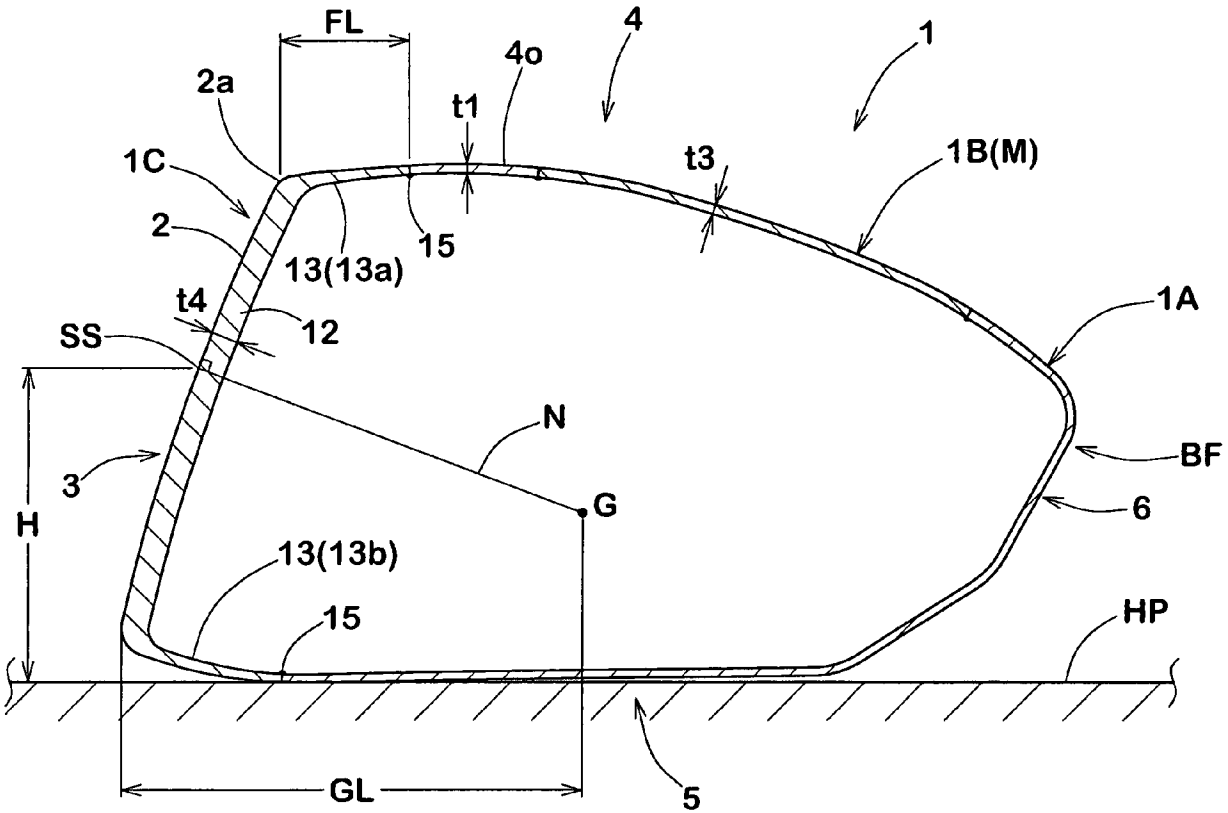
FIG. 3 is an enlarged cross sectional view taken along a line X-X in FIG. 2.

FIGS. 1 to 3 show a standard condition in which a golf club head 1 according to the present embodiment is grounded on a horizontal plane HP at its lie angle and its loft angle (real loft). In the drawings, the club head 1 according to the present invention is a hollow wood-type club head such as #1 driver and fairway wood having a cavity i therein.

The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and the sole portion 5 which extends from a toe-side edge 2*c* to a heel-side edge 2*d* of the club face 2 through the back face of the club head; and a hosel portion 7 to be attached to an end of a club shaft (not shown).

The club head 1 according to the present embodiment has a volume preferably not less than 400 $cm^3$, more preferably not less than 420 $cm^3$, and further preferably not less than 430 $cm^3$. Therefore, it is possible to increase a sweet spot area of the face portion and a moment of inertia of the head. In this case, an upper limit of the volume of the club head 1 is not particularly limited, however, when the volume of the head 1 is too large, some problems like increase of club weight, deterioration of swing balance, and a violation of the golf rules may cause. Therefore, the volume of the club head is preferably not more than 470 $cm^3$.

In the same manner, as a hollow wood type head, it is desirable that a mass of the club head 1 is preferably not less than 180 g and not more than 210 g, while taking swing balance and swing easiness into consideration.

Figure 4:
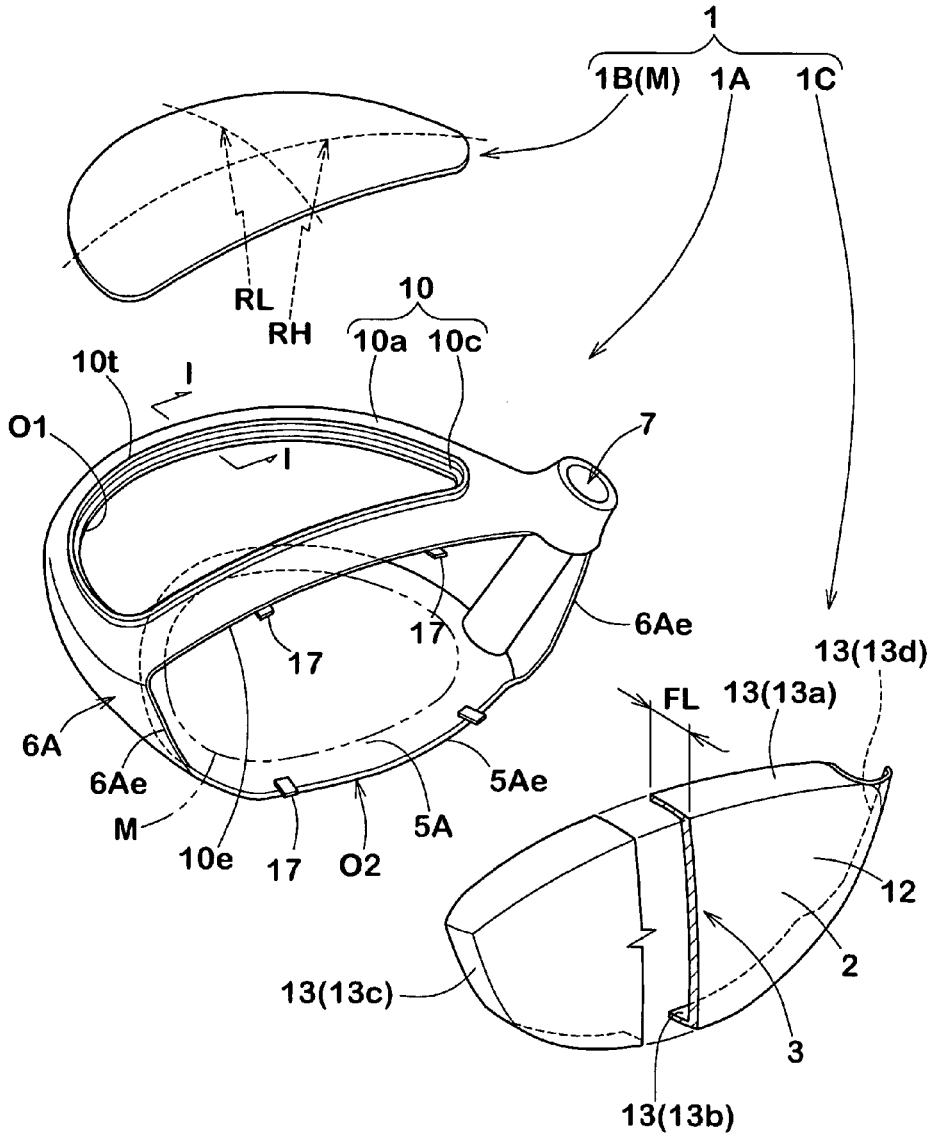
FIG. 4 is an exploded perspective view of the head before being assembled.

FIG. 4 shows an exploded view of the club head 1 before being assembled. In the present embodiment, the club head 1 is constituted of three parts including a head main body 1A, a crown plate 1B and a face member 1C, and these parts are formed by a metallic material. Accordingly, since the club head according to the present embodiment is entirely formed by the metallic material, a metallic shrill good ball hitting sound can be obtained in comparison with a combined head employing CFRP in the crown portion or the like. Therefore, it provides golfers with an excellent ball hitting feeling.

The head main body 1A is provided with a first opening O1 in the crown portion 4 and a second opening O2 in a side of the club face, respectively. The respective openings O1 and O2 are closed by the crown plate 1B and the face member 1C firmly attached to the head main body 1A.

Further, the head main body 1A comprises a sole main portion 5A forming a main portion of the sole portion 5, a side main portion 6A forming a main portion of the side portion 6, the hosel portion 7, and a crown edge portion 10 provided around the first opening O1 in the crown portion 4, and each of the portions is formed by one cast product (more particularly a lost wax precision cast product) previously integrally formed. In the cast product, since a complicated shape can be easily and integrally formed, productivity is improved.

The metallic material forming the head main body 1A is not particularly limited, however, it is desirable to employ a metallic material suitable for casting preferably such as a stainless steel, a maraging steel, a pure titanium, a titanium alloy (for example, Ti-6Al1-4V) or the like. However, the head main body 1A may be formed by forging, bending the rolled steel material or the like, and can be formed by bonding two or more parts.

The first opening O1 is provided within a region of the crown portion 4 without extending outside from the crown portion 4, in the present embodiment. Accordingly, the crown edge portion 10 continuously extends annularly around the first opening O1. However, the first opening O1 may be provided in such a manner that a part thereof extends to the side portion 6 from the crown portion 4. Further, a shape of the first opening O1 is not particularly limited, however, it is desirable to have a smooth outline shape approximately extending along an outline of the crown portion 4, as in the present embodiment.

The first opening O1 is closed by the crow plate 1B having a small thickness in the present embodiment. Accordingly, a weight of the crown portion 4 is reduced dependently on an area of the first opening O1, and the weight reduction contributes to a low center of gravity requirement of the head 1. In order to achieve a sufficient low center of gravity, it is desirable that an area of the first opening O1 is preferably not less than 40 $cm^2$, and more preferably not less than 50 $cm^2$. On the other hand, if the area of the first opening O1 becomes great, there is a risk that the durability of the crown portion 4 is deteriorated. Accordingly, it is desirable that the area is preferably not more than 75 $cm^2$, and more preferably not more than 65 $cm^2$. In this case, it is assumed that the area of the first opening O1 is calculated by an area obtained by projecting the opening O1 to a horizontal plane HP in a plan view of the head 1 in a standard condition, as shown in FIG. 2.

Figure 5:
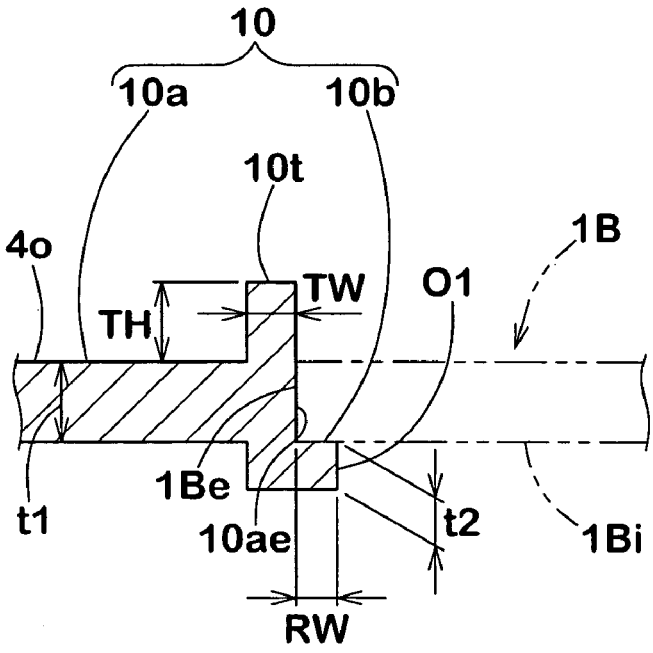
FIG. 5 is a cross sectional view taken along a line I-I in FIG. 4.

FIG. 5 shows a cross sectional view taken along a line I-I in FIG. 4. In the present embodiment, a crown edge portion 10 includes a crown main portion 10*a* having a substantially finish surface 4*o* of the crown portion 4, and a receiving portion 10*b* provided in such a manner as to be concaved in a step shape from the finish surface 4*o*. The receiving portion 10*b* supports an inner surface 1Bi of a peripheral edge portion of the crown plate 1B lapped thereon. Further, in the present embodiment, a projection 10*t* standing at a small height along an outer peripheral edge 1Be of the crown plate 1B supported by the receiving portion 10*b* is provided between the main portion 10*a* and the receiving portion 10*b*.

Each of the crown main portion 10*a*, the receiving portion 10*b* and the projection 10*t* is provided as a portion continuously extending annularly around the first opening O1. Further, the finish surface 4*o* of the crown portion 4 corresponds to a substantial outer surface of the finish head except a painting layer or the like, and may be formed as a surface which is approximately in parallel to an outer surface in which some grinding margin or the like is allowed. Further, an inner surface 1Bi of the crown plate 1B corresponds to a surface directed to the hollow i side of the crown plate 1B.

Further, the crown edge portion 10 has an inner peripheral edge 10*ae* facing the outer peripheral edge 1Be of the crown plate 1B. The inner peripheral edge 10*ae* is similar to an outline shape of the crown plate 1B, but it has the outline shape which is slightly larger than the outline shape of the crown plate 1B. Accordingly, it is possible to fit the crown plate 1B toward the receiving portion 10*b* from the above, and a small gap is formed between the outer peripheral edge 1Be of the crown plate 1B supported by the receiving portion 10*b* and the inner peripheral edge 10*ae*. The gap is joined later.

In order to secure the durability and the casting property of the crown portion 4, it is preferable that a thickness t1 of the crown main portion 10*a* is preferably not less than 0.4 mm, and more preferably not less than 0.6 mm. On the other hand, if the thickness t1 of the main portion 10*a* becomes larger, the weight of the crown portion 4 becomes larger. Accordingly, the thickness t1 of the crown main portion 10*a* is preferably not more than 0.9 mm, and more preferably not more than 0.8 mm.

Since a step amount (a concave amount) from the outer surface of the crown main portion 10*a* is optimized, the receiving portion 10*b* contributes to flush finishing the respective outer surfaces of the crown plate 1B supported thereon and the crown main portion 10*a*. Accordingly, it is possible to simplify a later surface finishing process by the grinding or the like, and to serve for improving productivity.

In order achieve the low center of gravity of the club head 1, it is preferable that a width RW of the receiving portion 10*b* is small. On the other hand, if the width RW of the receiving portion 10*b* is too small, the support is not stabilized at a time of fitting the crown plate 1B to the receiving portion 10*b* so as to fix. Accordingly, a positioning precision of both parts 1A and 1B is deteriorated, and a defective joint tends to be generated. From this point of view, it is desirable that the receiving portion 10*b* is formed at a small width RW which is preferably less than about 1.0 mm, and more preferably about from 0.3 to 0.8 mm, although not being limited.

The width RW is measured in a direction orthogonal to an edge of the first opening O1. The width RW of the receiving portion 10*b* may be fixed or changed. In the case that the width RW is changed, it is desirable that an average width weighted by a length along the opening O1 is about from 0.3 to 0.8 mm, and it is desirable that the maximum value of the width satisfies the numerical value range above all.

Figure 6:
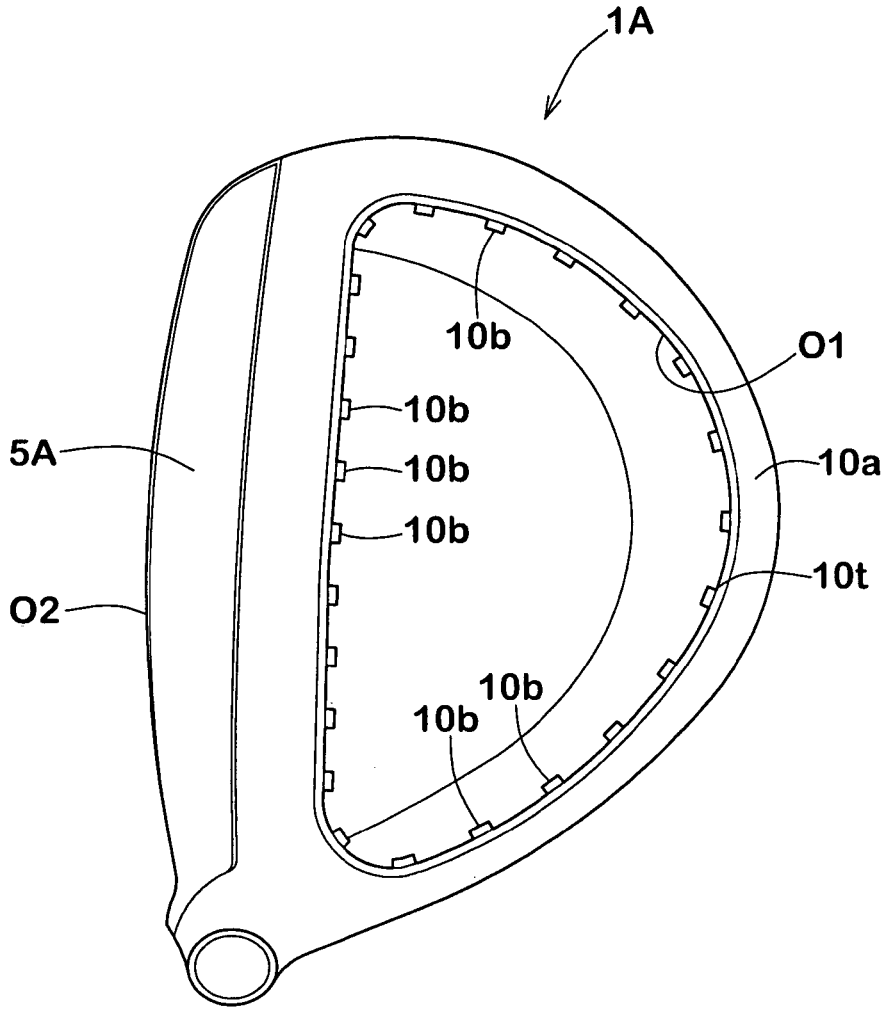
FIG. 6 is a plan view showing the other embodiment of a head main body.

Further, as shown in FIG. 6, the receiving portion 10*b* may be intermittently provided around the first opening O1. In this case, in order to prevent a joint strength from being lowered, it is desirable that a total length of the receiving portion 10*b* along the first opening O1 is at least not less than 30% of an entire peripheral length of the first opening O1, more preferably not less than 50%, and further preferably not less than 70%.

Further, a thickness t2 (shown in FIG. 5) of the receiving portion 10*b* is not particularly limited. However, if it is too small, there is a risk that a breakage or a deformation occurs at a time of fitting the crown plate 1B so as to temporarily fix. On the other hand, if the thickness t2 of the receiving portion 10*b* is too large, the weight reduction effect of the crown portion 4 is lowered. From this point of view, the thickness t2 is preferably not less than 0.5 mm, and more preferably not less than 0.6 mm, and an upper limit thereof is preferably not more than 0.8 mm, and more preferably not more than 0.7 mm.

The projection 10*t* serves as a guide member at a time of mounting the crown plate 1B onto the receiving portion 10*b*. Further, since the projection 10*t* has a height TH from the finish surface 4*o*, it is possible to more stably hold the position of the crown plate 1B even after mounting the crown plate 1B onto the receiving portion 10*b*. Therefore, it is possible to precisely position both the parts 1A and 1B.

Although not being particularly limited, the height TH of the projection 10*t* is preferably not less than 0.8 mm, and more preferably not less than 1.0 mm, in order to make the projection 10*t* achieve the function mentioned above. On the other hand, if the height TH is too large, it takes a lot of trouble to later remove the projection 10*t* by the grinding or the like. Accordingly, the height TH is preferably not more than 1.8 mm, and more preferably not more than 1.5 mm. Further, from the same point of view, the width Tw of the projection 10*t* is preferably not less than 0.6 mm, and more preferably not less than 0.7 mm, and an upper limit thereof is preferably not more than 1.2 mm, and more preferably not more than 1.0 mm. In this case, the projection 10*t* may be provided intermittently around the first opening O1 (not shown).

Figure 7:
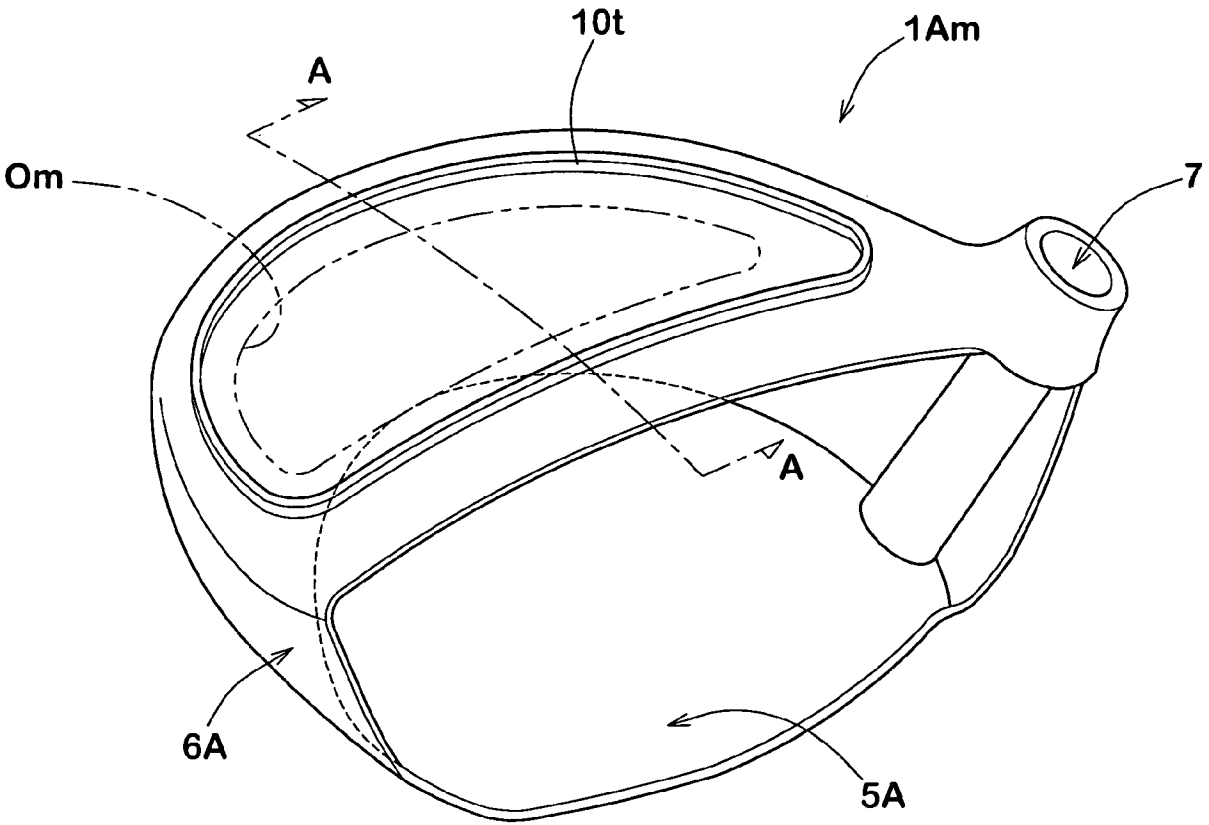
FIG. 7 is a perspective view showing a primary molded product of the head main body.
Figure 8:
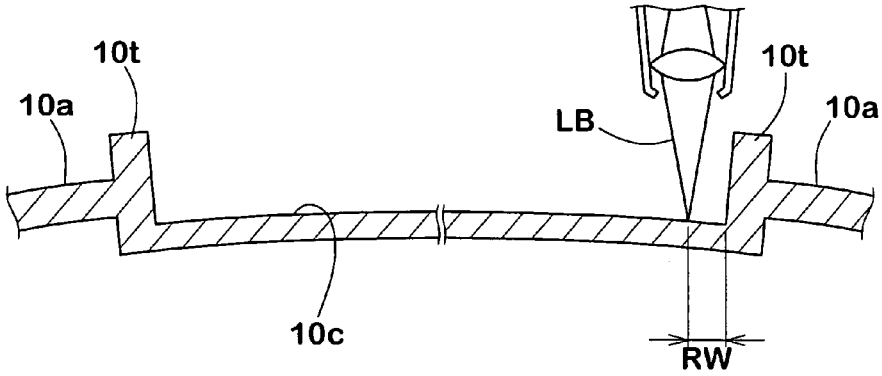
FIG. 8 is a cross sectional view taken along a line A-A in FIG. 7.

Further, as shown in FIGS. 7 and 8, the head main body 1A according to the present embodiment is first molded as a primary molded product 1Am of the head main body provided with no first opening O1 by a casting. It is different from the head main body 1A in that the first opening O1 is not provided, however, is substantially identical in the other structures. Further, the structure in which the first opening O1 is not provided includes an aspect that a temporary opening Om smaller than the first opening O1 is provided, in addition to an aspect that the first opening O1 is not absolutely provided.

Figure 9:
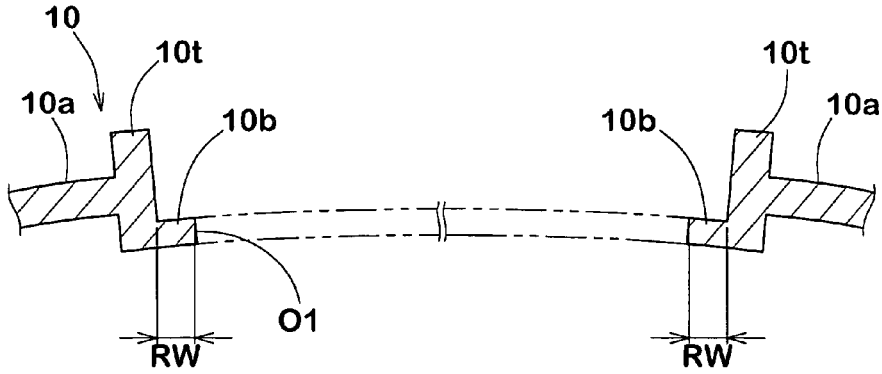
FIG. 9 is a cross sectional view taken along a line A-A in FIG. 7 in which an opening is formed.

Thereafter, the head main body 1A is prepared (manufactured) by forming the first opening O1 in the primary molded product 1Am of the head main body, for example, by a laser process. In the laser process, as shown in FIG. 8, a laser beam LB is sequentially irradiated along a position which is away from an inner periphery of the projection 10*t* at a predetermined distance, for example, from an outer side of the head. Accordingly, as shown in FIG. 9, the first opening O1 is bored except the receiving portion 10*b* of the width RW. If it is intended to form the receiving portion 10*b* having a very small width RW only by a casting, there is a tendency that an accurate shape can not be obtained due to a molten metal jam. However, it is possible to precisely form the receiving portion 10*b* having the small width RW together with the first opening O1, by applying the laser process using the laser beam having a high energy density after the casting mold as in the present embodiment.

Further, the second opening O2 of the head main body 1A comprises a front edge 5Ae of the sole main portion 5A, a front edge 10*e* of the crown edge portion 10, and a front edge 6Ae of the side main portion 6A connecting therebetween in a toe side and a heel side. They are formed substantially by a casting.

In the present embodiment, the face member 1C integrally has a base portion 12 forming the club face 2, and a turn-back portion 13 extending to a back face BF side from at least a part of the edge 2*a* to 2*d* of the club face 2 at a length FL, as shown in FIGS. 3 and 4. The base portion 12 and the turn-back portion 13 mentioned above are integrally structured in accordance with a bending process including a press molding or the like, a casting, a forging or the like, not by a welding process.

As a material forming the face member 1C, it is preferable to employ a titanium alloy, although not being limited, and preferably Ti-15V-3Cr-3Al-3Sn, Ti-22V-4Al (DAT51), Ti-6Al-4V, Ti-13V-11Cr-3Al or Ti-4.5Al-2Mo-1.6V-0.5Fe and the like, above all.

The base portion 12 is structured such as to include a substantially entire region of the club face 2 in the present embodiment. A thickness t4 of the base portion 12, that means a thickness of the face portion 3, is preferably not less than 3.00 mm, more preferably not less than 3.05 mm, and further preferably not less than 3.10 mm, although not being limited. On the other hand, if the thickness t4 of the face portion 3 becomes larger, there is a tendency that a depth of center of gravity GL becomes smaller, and a moment of inertia becomes smaller. From this point of view, the thickness t4 is preferably not more than 3.40, more preferably not more than 3.35 mm, and further preferably not more than 3.30 mm. In the present embodiment, there is shown the structure in which the thickness t4 of the face portion 3 is substantially constant, however, the present invention includes an aspect that the thickness t4 varies in the respective portions.

Further, the turn-back portion 13 includes a crown turn-back 13*a* forming a front side (the face portion 3 side) of the crown portion 3, a sole turn-back 13*b* forming a front side of the sole portion 4, a toe turn-back 13*c* forming a front side in a toe side portion of the side portion 5, and a heel turn-back 13*d* forming a front side in a heel side of the side portion 5, in the present embodiment. Accordingly, the face member 1C is formed as an approximately bowl shape in a general view. Further, a portion facing a hosel portion 7 is notched in a concave shape.

In the present embodiment, the face member 1C is attached to the second opening O2 of the head main body 1A by welding. Specifically, the respective turn-backs 13*a*, 13*b*, 13*c* and 13*d* respectively face to the crown edge portion 10, the sole main portion 5A, the side main portion 6A in the toe side and the side main portion 6A in the heel side of the head main body 1A so as to be welded and firmly attached. At this time, the second opening O2 of the head main body 1A is provided with a catch piece 17 or the like capable of temporarily holding the face member 1C by insertion, as shown in FIG. 4. Accordingly, it is possible to simply and stably execute the positioning of both the part 1A and 1C at a time of welding, and the workability is improved.

The welding process can employ various methods, however, the present embodiment employs a laser welding in which a thermal effect of the weld portion to the periphery is very small. In this case, the laser welding will be described later in detail.

Since the face member 1C according to the present embodiment is welded to the head main body 1A at a position which is away from the edge of the club face 2 to the rear side of the head, by providing the turn-back portion 13, it is possible to obtain a good welding workability. Further, a weld bead 15 (shown in FIG. 3) remaining in the hollow i is left at a position which is away from the face portion 3 to the back face BF side. If the weld bead 15 remains in the portion near the edges 2*a* to 2*e* of the club face 2, a rigidity of the face portion 3 is increased, so that there is a problem that a repulsion performance of the head is lowered.

From the point mentioned above of view, a length FL of the turn-back portion 13 in a front-back direction of the head is preferably not less than 3 mm, and further preferably not less than 5 mm. On the other hand, if the length FL is too large, there is a risk that the productivity is lowered. From this point of view, the length FL of the turn-back portion 13 is preferably not more than 30 mm, particularly preferably not more than 20 mm, and further preferably not more than 15 mm. In this case, it is not necessary that the turn-back portion 13 is continuously formed annularly as in the present embodiment, but the effect can be achieved as far as the turn-back portion 13 is provided in a part of the edge of the club face 2.

In the present embodiment, the crown plate 1B is made of a rolled steel material M and attached to the head main body 1A in such a manner that a rolling direction K thereof is in the range of from 0 to 20 degrees with respect to a front-back direction Y of the head, as shown in FIG. 2.

Figure 10:
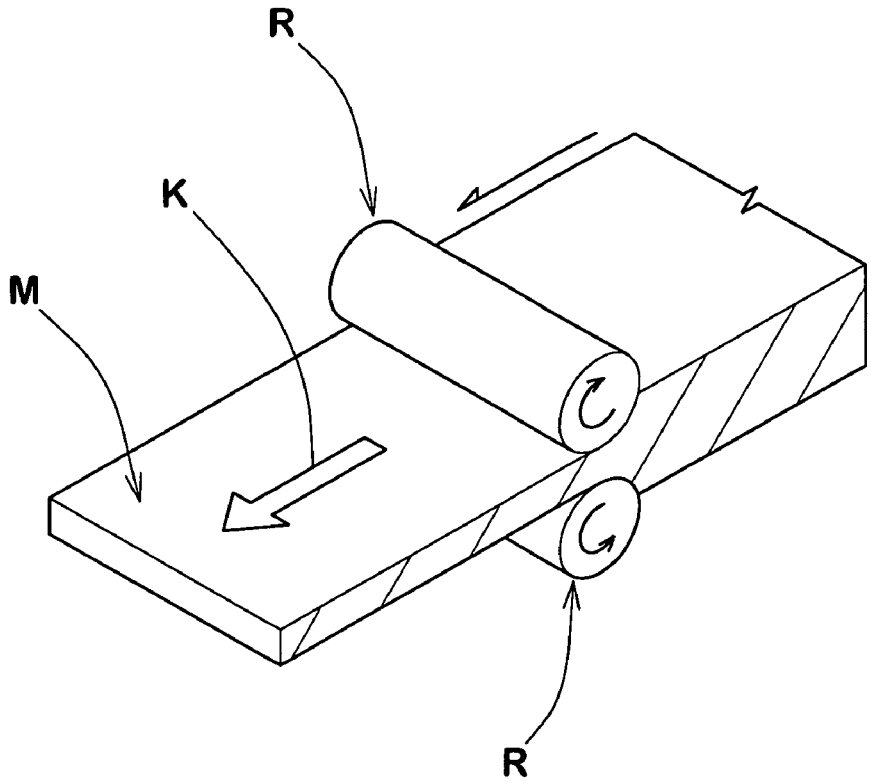
FIG. 10 is a schematic view explaining a rolled steel material.

In the present specification, the rolled steel material means a material manufactured via a rolling process for reducing a thickness and/or a cross sectional area by repeating a process of pinching a metallic material between a pair of rotating rolls R and R by a friction, at least one time, preferably a plurality of times, as shown in FIG. 10. Accordingly, for example, a casting, a forging, a grinding process of the metal material may be executed before the rolling process, or a press bending, a punching or cutting process, and a heat treatment process or the like as occasion demands may be executed after the rolling process.

Further, the rolling direction K is defined as a direction in which the rolled steel material M is rolled (a direction along the surface of the rolled steel material and perpendicular to an axial direction of the roll R), as shown in FIG. 10. Since a crystal grain of the rolled steel material M grows along the rolling direction K, the crystal grain becomes longer along the rolling direction K. Accordingly, the rolling direction K can be specified by observing a crystal structure of the crown plate 1B by an optical or electron microscope, and searching a longitudinal direction of the crystal grain. Further, in the present specification, the rolling direction K is specified at a position of an area gravity center of a projected outline obtained by projecting the crown plate 1B on the horizontal plane HP, in the standard condition.

Further, the front-back direction Y of the head is defined as a direction obtained by projecting a vertical line N drawn to the club face 2 from the center of gravity G of the club head onto the horizontal plane HP, in a plan view of the head 1 in the standard condition, as shown in FIG. 2.

Further, an angle of the rolling direction K of the rolled steel with respect to the front-back direction Y of the head is measured as an angle θ formed by the rolling direction K and the front-back direction Y of the head at the horizontal plane HP, as shown in FIG. 2.

In the rolled steel material M, a Young's modulus along the rolling direction K becomes larger in comparison with a Young's modulus along a direction (hereinafter, refer to "rolling perpendicular direction") orthogonal to the rolling direction along the surface of the rolled steel. In other words, it has an orthotropy. On the other hand, the crown portion 4 receives a great stress along the front-back direction Y of the head at a time of hitting ball.

Accordingly, it is possible to suppress a strain of the crown portion 4 at a time of hitting ball, by arranging the crown plate 1B made of the rolled steel material M with the rolling direction K which is approximately in parallel to the front-back direction Y of the head, that is, at the angle θ not more than 20 degrees. Therefore, a repulsion performance of the club head 1 can be improved, in addition that the durability of the crown plate 1B is improved.

Further, in the rolling perpendicular direction substantially extending along the toe-heel direction, the Young's modulus of the crown plate 1B becomes relatively smaller. Accordingly, the club head 1 according to the present invention absorbs an impact force at a time of hitting ball by a flexible deformation of the rolled steel material M in the toe-heel direction, and provides an improved ball hitting feeling.

Further, it is possible to employ a thinner plate for the crown plate 1B. This easily achieves a low center of gravity G of the club head 1, and enlarges an initial flight angle of the ball, whereby an increase of carry can be expected.

Since the operation mentioned above can be obtained in the sole portion 5 in the same manner, the rolled steel material M may be used in the sole portion 5 together with the crown portion 4 or only in the sole portion 5.

Further, the angle θ is preferably not more than 10 degrees, and further preferably not more than 5 degrees. Accordingly, the effect mentioned above can be further increased.

The rolled steel material M is rolled at a predetermined draft. The draft mentioned above corresponds to a parameter indicating a degree of the rolling given by the following expression (1) in the case that a material thickness before being rolled is set to h1, and a material thickness after being rolled is set to h2.

$$\text{Draft}\,[\%]=\{(h1-h2)/h1\}\times 100 \quad (1)$$

If the draft is too small, a dislocation density can not increased in the rolled steel material, and there is a tendency that it is impossible to sufficiently obtain an improvement in a tensile strength, anisotropy of a Young's modulus and the like by a work hardening. Accordingly, the draft of the rolling process is preferably set not less than 20%, more preferably not less than 25%, and further preferably not less than 30%. on the other hand, if the draft is too large, since a great working equipment is necessary, the productivity and the cost tend to be deteriorated. Accordingly, the draft is preferably set not more than 50%, more preferably not more than 45%, and further preferably not more than 40%.

Above all, it is desirable to adjust the draft in such a manner that a ratio (E1/E2) between a Young's modulus in the rolling direction of the rolled material M and the Young's modulus E2 in the rolling perpendicular direction is more than 1.0, preferably not less than 1.10, and further preferably not less than 1.15.

Further, in the rolling process, a rolling frequency (a frequency passing through the roll R) is defined on the basis of a relation with the draft. In other words, in the case that the rolling frequency is small, it is unavoidable that the draft in one rolling process becomes large, and a defect such as a crack or the like tends to be caused in the material. On the contrary, if the rolling frequency is too much, the productivity tends to be deteriorated. From-this point of view, the rolling frequency is preferably not less than 3, and more preferably not less than 4, and an upper limit thereof is preferably not more than 8, and more preferably not more than 7.

Further, the rolled steel material may particularly employ a cold rolled steel material in which a non-heated material is rolled, or a hot rolled steel material in which a heated material is rolled, however, the cold rolled steel material is desirable in the light of the productivity.

Further, as the rolled steel material M, it is preferable to employ, for example, a titanium alloy, and preferably a β-titanium alloy having a great specific intensity and being excellent in a rolling workability in the cold condition such as Ti-15V-3Cr-3Al-3Sn or Ti-4.5Al1-3v-2Mo-2Fe (SP700) above all.

Figure 11A:
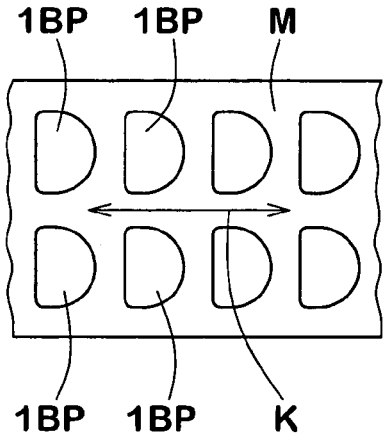
FIG. 11A is a plan view showing an example in which a crown plate is taken from the rolled steel.
Figure 11B:
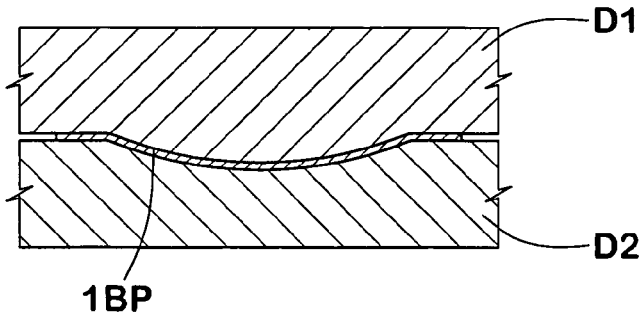
FIG. 11B is a cross sectional view of a bending process of the crown plate.

As a specific process for forming the crown plate 1B from the rolled steel material M, for example, a crown part 1BP for the crown plate having a predetermined shape is punched out from the rolled steel material M by a press molding, as shown in FIG. 11A. At this time, the crown part 1BP is punched out while taking into consideration a relative relation between the front-back direction of the head and the rolling direction K. Thereafter, as shown in FIG. 11B, the crown part 1BP is pressed, for example, by a pair of a die D1 and a mold D2, and an outline shape is arranged by cutting an end portion as occasion demands. Accordingly, as shown in FIG. 4, the crown plate 1B is formed in such a manner as to be three-dimensionally curved in a smooth convex shape respectively toward radii RL and RH of curvature in the front-back direction of the head and the toe-heel direction.

Figure 12:
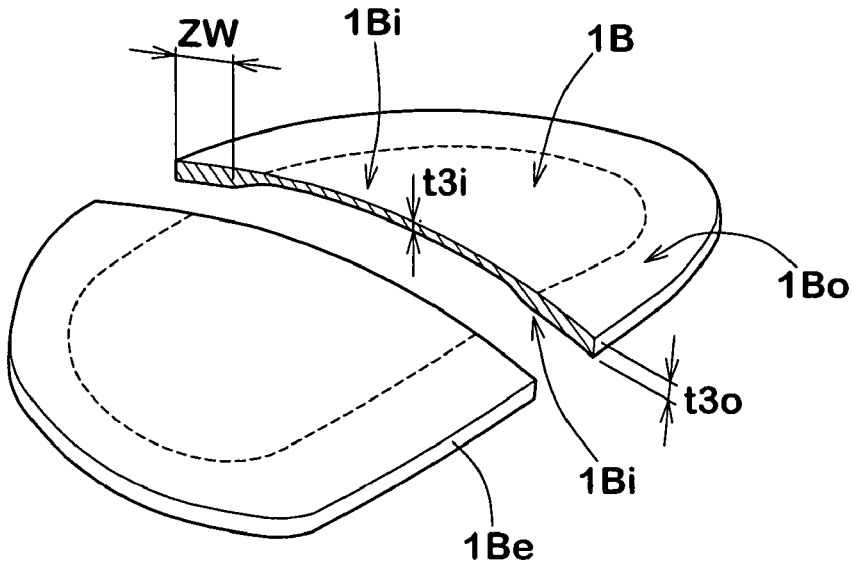
FIG. 12 is an enlarged perspective view of the crown plate.

Further, as shown in FIG. 12, the crown plate 1B comprises a peripheral portion 1Bo having a great thickness t3*o* and a center portion 1Bi having a smaller thickness t3*i* than the peripheral portion 1Bo, as relative elements. In this present embodiment, the center portion 1Bi is provided by forming the outer surface of the crown plate 1B by a substantially smooth and concaving the center portion of the inner surface 1Bi. The crown plate 1B mentioned above is manufactured, for example, by applying the press molding or the cutting process after the rolling.

The peripheral portion 1Bo is formed in an annular shape at an approximately fixed width zw including the outer peripheral edge 1Be of the crown plate 1B, in the present embodiment. It is desirable that the width zw is, for example, about from 3 to 10 mm. Further, the thickness t3*o* of the peripheral portion 1Bo is not particularly limited, however, if it is too large, the weight of the crown portion 4 becomes large and the center of gravity G of the club head becomes higher. On the other hand, since the peripheral portion 1Bo is attached to the head main body 1A, if it is too small, it lowers a durability of its joint. From this point of view, the thickness t3*o* is preferably not less than 0.40 mm, and further preferably not less than 0.60 mm, and an upper limit thereof is preferably not more than 0.90 mm, and more preferably not more than 0.80 mm.

Further, a ratio (t1/t3*o*) between the thickness t3*o* of the peripheral portion 1Bo and the thickness t1 of the crown main portion 10*a* is preferably not less than 0.7, more preferably not less than 0.8, and further preferably not less than 0.9, and an upper limit thereof is preferably not more than 1.3, more preferably not more than 1.2, and further preferably not more than 1.1. AS mentioned above, it is desirable that the thickness t3*o* of the peripheral portion 1Bo of the crown plate 1B is made approximate to the thickness t1 of the crown main portion 10*a*. If the thicknesses t1 and t3*o* are different, an excessive weld penetration may be generated during welding on the basis of a difference of thermal capacity, and a defective joint tends to be generated. Further, since a step between the crown main portion 10*a* and the crown plate 1B is generated, a lot of time is needed for grinding the step into flat.

Further, from the same point of view as the thickness t3*o* of the peripheral portion 1Bo, the thickness t3*i* of the center portion 1Bi is preferably not less than 0.30 mm, and more preferably not less than 0.35 mm, although not being particularly limited, and it is desirable that the upper limit is preferably not more than 0.60 mm, and more preferably not more than 0.50 mm. In the center portion 1Bi according to the present embodiment, the thickness is smoothly reduced toward its center from the peripheral portion 1Bo side. Accordingly, a stress concentration or the like is hard to be generated, and the durability of the crown portion 4 is improved.

Further, a ratio (t1/t3*i*) between the thickness t3*i* of the center portion 1Bi and the thickness t1 of the main portion 10*a* is preferably set in the range of from 1.2 to 2.0.

Further, a ratio (t3*o*/t3*i*) between the thickness t3*i* of the center portion 1Bi and the thickness t3*o* of the peripheral portion 1Bo is preferably set in the range of from 1.2 to 2.0.

Further, an entire average thickness ta of the crown plate 1B is preferably set not less than 0.35 mm, and more preferably not less than 0.40 mm, and an upper limit thereof is preferably set not more than 0.85 mm, more preferably not more than 0.80 mm, and further preferably not more than 0.70 mm. In this case, the average thickness ta is given by the following expression (2).

$$Ta=\Sigma(t3a\bullet Sa)/\Sigma Sa(a=1, 2, \ldots) \quad (2)$$

In this case, t3*a* is set to an actual thickness of an optional region "a" of the crown plate, and "Sa" is set to an area of the region "a".

In views of the durability and the weight saving of the crown portion, it is desirable that a ratio (t1/ta) between the average thickness ta and the thickness t1 of the main portion 10*a* is preferably set not less than 1.1, more preferably not less than 1.2, and further preferably not less than 1.3, and an upper limit thereof is preferably not more than 1.8, more preferably not more than 1.6, and further preferably not more than 1.5.

Next, a description will be given of a bonding method between the crown plate 1B and the head main body 1A.

Figure 13A:
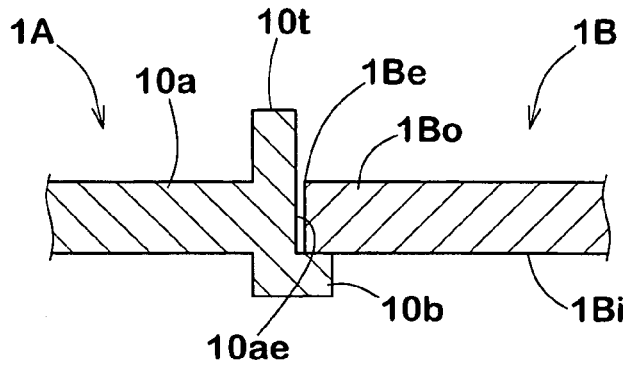
FIGS. 13A to 13C are partial cross sectional views explaining a weld process between the head main body and the crown plate.

As shown in FIG. 13A, the crown plate 1B is fitted to a region surrounded by the projection 10*t* of the head main body 1A. Accordingly, the inner surface 1Bi of the peripheral portion 1Bo of the crown plate 1B is mounted on the receiving portion 10*b* and is held. The outer surface of the receiving portion 10*b* and the inner surface 1Bi of the crown plate 1B are previously worked accurately in such a manner that the positioning of both the members 1A and 1B is correctly executed.

Figure 13B:
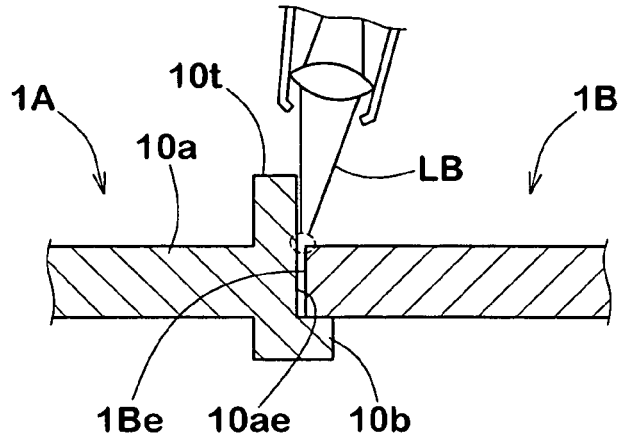

Next, as shown in FIG. 13B, there is executed a process of bonding between the outer peripheral surface 1Be of the crown plate 1B and the inner peripheral surface 10*ae* of the main portion 10*a* of the head main body (including the inner peripheral surface of the projection 10*t* of the head main body 1A) by a laser welding, from the outside of the head 1. In the present embodiment, in order to reduce the weight of the crown portion 4, the receiving portion 10*b* having the very small width RW is employed as mentioned above. Further, the rolled steel material having the very small thickness is employed in the crown plate 1B. As mentioned above, in the case of bonding the parts having the very small widths and thicknesses to each other, if a plasma welding or the like is used, a thermal effect comes to a wide range around the weld portion, and there is a problem that a hole is formed in the crown plate 1B or the crown plate 1B is deformed. Further, if the weld time becomes longer, a denaturation of the metal structure tends to be generated around the joint portion.

Then, according to the present embodiment, a laser welding is used for bonding the head main body 1A and the crown plate 1B. Since the laser welding can irradiate a thermal energy having a high density to a very small range by pinpoint, it is possible to weld for a short time. This restricts the thermal effect such as the denaturation, the deformation and the like of the peripheral structure to the minimum, and it is possible to securely bond the members 1A and 1B having the small capacities as mentioned above.

Figure 13C:
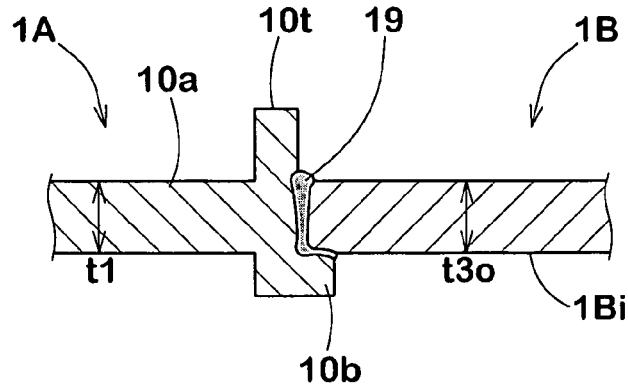

Further, in the laser welding, as shown in FIG. 13B, it is possible to precisely irradiate a laser beam LB to a gap between the head main body 1A and the crown plate 1B. By the irradiation of the laser beam LB, the respective parts 1A and 1B melt in each other and are bonded by solidification thereof. Particularly in the laser welding, since the weld penetration having a very large depth can be locally obtained, it is possible to obtain a deep weld bead 19 reaching the receiving portion 10*b*, as shown in FIG. 13C. Accordingly, it is possible to obtain a higher joint strength while restricting a peripheral thermal damage to the minimum.

Figure 14:
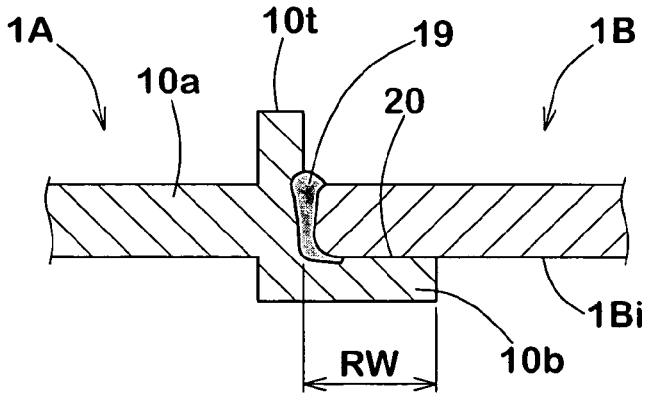
FIG. 14 is a cross sectional view showing the other joint state between the head main body and the crown plate.

Further, as shown in FIG. 13C, the molten metal flows into a boundary face between the receiving portion 10*b* of the head main body 1A and the inner surface 1Bi of the crown plate 1B, the boundary face having a small resistance. At this time, since the width RW of the receiving portion 10*b* of the head main body 1A is made small, the weld bead 19 is formed in a substantially entire region of the boundary face. Accordingly, a firm bonding effect can be obtained, and a very high bonding strength can be obtained. If the width RW of the receiving portion 10*b* is larger than 0.8 mm, the weld bead 19 in which the molten metal is solidified can not fill fully in the portion between the receiving portion 10*b* and the crown plate 1B, as shown in FIG. 14, but the crack or the like grows from the boundary face 20 by repeatedly hitting the ball, so that the breakage of the joint portion tends to occur.

Further, the laser welding can restrict the thermal effect to the peripheral portion to the minimum, however, a part of the thermal effect is transferred to the crown main portion 10*a* of the head main body 1A. At this time, the projection 10*t* absorbs a part of the heat quantity so as to discharge to the outside of the club head. Accordingly, the projection 10*t* functions as a heat radiating member restricting the thermal effect to the crown main portion 10*a* to the minimum.

The laser welding preferably employs, for example, a carbon dioxide gas laser using a carbon dioxide, and a yttrium-aluminum-garnet (YAG) laser. Above all, the YAG laser is preferable since it is possible to easily obtain a laser having a high output power and a high energy density.

Further, since the laser welding can be executed in various environments, for example, in the atmospheric air, in the inert gas atmosphere, in the vacuum and the like, the laser welding is preferable in a point that it does not essentially require a vacuum chamber as is different from an electron beam welding.

In this case, the projection 10*t* provided in the head main body 1A can be left in the head 1 as it is after welding the crown plate 1B. However, since a weight increase of the crown portion 4 is caused, it is desirable to further execute a process of removing the projection 10*t* after the laser welding. This process can be easily executed, for example, by cutting the projection 10*t* by a machine work. Accordingly, it is possible to form the crown portion 4 by the smooth convex curved surface having no concavity and convexity, and to improve a sense of beauty.

Figure 15A:
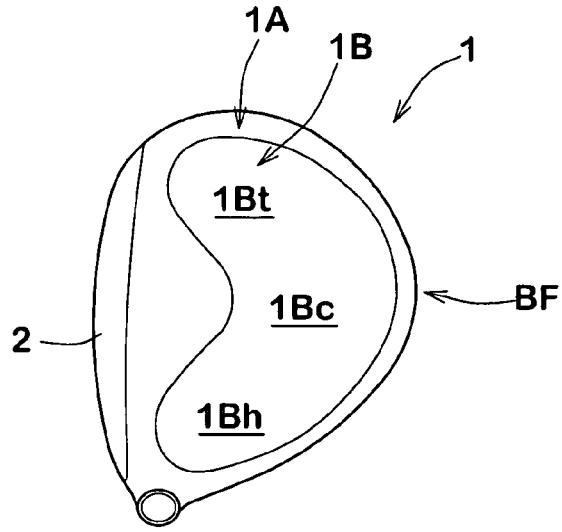
FIG. 15A to 15C is a plan view showing the other embodiment of the head main body and the crown plate.
Figure 15B:
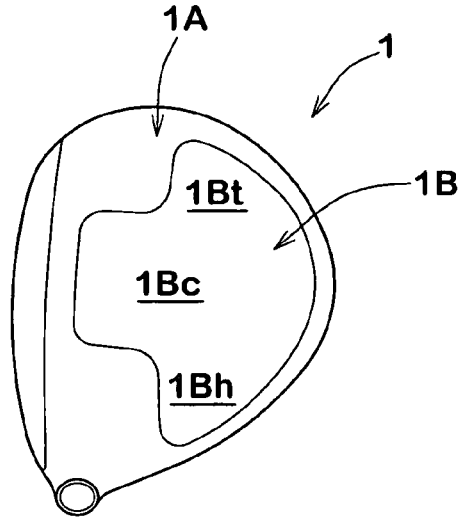
Figure 15C:
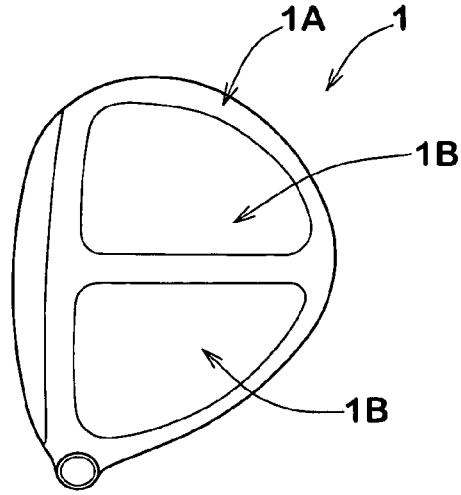

FIGS. 15A to 15C show the other embodiments according to the present invention.

FIG. 15A shows an approximately transverse V-shaped structure in which the crown plate 1B is formed convex toward the back face BF side. Accordingly, the crown plate 1B includes a center portion 1Bc being separated a large distance from the upper edge 2*a* of the club face 2 in the front-back direction, and a toe side portion 1Bt and a heel side portion 1Bh provided in both sides of the center portion 1Bc and being separated a small distance from the upper edge 2*a* of the face 2, as relative elements. In the crown plate 1B mentioned above, since the center portion 1Bc in which the impact stress at a time of hitting ball is the largest is away from the club face 2 to the maximum, it is possible to achieve an excellent durability.

The other aspect in FIG. 15B includes a center portion 1Bc being separated by a smallest distance from the upper edge 2*a* of the club face 2, and a toe side portion 1Bt and a heel side portion 1Bh provided in both sides of the center portion 1Bc and being separated by a large distance from the upper edge 2*a* of the club face 2 in the front-back direction of the head, as relative elements, conversely to the aspect in FIG. 15A. In the club head 1 mentioned above, since the toe side and heel side weight of the crown portion 4 becomes relatively larger, it is possible to increase a moment of inertia around a vertical axis passing through the center of gravity G of the head. Accordingly, it is possible to provide an excellent directionality.

Further, in an aspect in FIG. 15C, there is shown a head 1 provided with a plurality of crown plates 1B. The number of the crown plates is two in this embodiment, however, may be set to three or more.

The description is given above of the embodiments according to the present invention by exemplifying the wood type golf club head, however, the present invention is not limited to the aspect mentioned above, but can be applied to various golf club heads such as an iron type, a utility type or a putter type. Further, the rolled steel material M may be arranged in a part of the sole portion 5 in addition to the crown portion shown in FIG. 4.

Comparison Test:

In order to confirm some advantages of the present invention, a plurality of wood type golf clubs were manufactured based on the specification of Table 1. The common specifications of the club head are as follows.

| | |
|---|---|
| Loft angle: | 11.0 degrees |
| Lie angle: | 57.5 degrees |
| Material | |
| Head main body: | Ti—6Al—4V |
| Crown plate: | Ti—15V—3Cr—3Al—3Sn |
| Face member: | Ti—5.5Al—1Fe |
| Thickness t4 of face portion: | 3.2 mm |

Further, each of the head main body was manufactured by dissolving the ingot of the titanium alloy, forming the primary molded product of the head main body as shown in FIG. 7 by means of a lost wax precision casting method, and forming the first opening in the crown portion by a laser process.

Further, the crown plate was manufactured so as to include a curve protruding to an outer side of the head by pressing the rolled steel material of the titanium alloy, and was firmly attached to the first opening of the head main body in accordance with a laser welding.

Further, the face member was formed in an approximately bowl shape as shown in FIG. 4 by hot forging the titanium alloy, and was firmly attached to the head main body by a carbon dioxide gas laser welding.

The test method is as follows.

Repulsion-Performance Test:

The rebound performance of the head was obtained by calculating the repulsion coefficient on the basis of Procedure for Measuring the velocity Ratio of a Club Head for conformance to Rule 4-1e, Revision 2 (Feb. 8, 1999) in U.S.G.A. The larger numerical value is better.

Durability Test:

A plurality of wood type golf clubs with a length of 45 inch were manufactured by attaching the same carbon shafts (v-25 FLEX-X manufactured by SRI sports Ltd.) to each of the club heads, and ball hitting tests at a head speed of 54 m/s were performed in all the clubs by using a swing robot. Then the number of hitting times until any damage was caused in the face portion was counted.

Ball Hitting Feeling

Each of ten golfers (having handicaps between 10 and 15) hit five commercially available 3-piece golf balls ("Hi-BRID everio" manufactured by SRI sports Ltd.) by using each of the test clubs mentioned above, and a ball hitting feeling was evaluated by sense on the basis of the following standard.

5: very soft hitting feeling

4: little soft hitting feeling

3: common

2: little hard hitting feeling

1: very hard hitting feeling

Then, the evaluation is executed on the basis of average values of ten golfers. The larger the numerical value is, the better the feeling is.

The results are shown in Table 1.

TABLE 1

| | EX. 1 | Ex. 2 | Ex. 3 | Ref. 1 | Ref. 2 | Ref. 3 | Ref. 4 | Ex. 4 | Ex. 5 |
|---|---|---|---|---|---|---|---|---|---|
| Head volume [$cm^3$] | 430 | 430 | 450 | 430 | 450 | 430 | 430 | 430 | 430 |
| Head weight [g] | 195 | 195 | 195 | 195 | 195 | 195 | 195 | 195 | 195 |
| Area of first opening [$cm^2$] | 65 | 65 | 70 | 65 | 70 | 65 | 65 | 65 | 65 |
| Thickness t1 of crown main portion [mm] | 0.70 | 0.70 | 0.60 | 0.70 | 0.65 | 0.70 | 0.70 | 0.70 | 0.70 |
| Angle θ between rolling direction of crown plate and front-back direction [deg] | 0 | 0 | 0 | 90 | 90 | 45 | 25 | 5 | 15 |
| Thickness t3o of peripheral portion of crown plate [mm] | 0.70 | 0.70 | 0.65 | 0.70 | 0.65 | 0.70 | 0.70 | 0.70 | 0.70 |
| Thickness t3i of center portion of crown plate [mm] | 0.50 | 0.40 | 0.30 | 0.50 | 0.40 | 0.50 | 0.50 | 0.50 | 0.50 |
| Average thickness ta of crown plate [mm] | 0.55 | 0.46 | 0.35 | 0.55 | 0.44 | 0.55 | 0.55 | 0.55 | 0.55 |
| Ratio (t1/t3o) | 1.0 | 1.0 | 0.93 | 1.0 | 1.0 | 1.0 | 1.0 | 1.0 | 1.0 |
| Ratio (t1/t3i) | 1.4 | 1.75 | 2.0 | 1.4 | 1.63 | 1.4 | 1.4 | 1.4 | 1.4 |
| Ratio (t1/ta) | 1.27 | 1.52 | 1.71 | 1.27 | 1.48 | 1.27 | 1.27 | 1.27 | 1.27 |
| Ratio (t3o/t3i) | 1.4 | 1.75 | 2.0 | 1.4 | 1.63 | 1.4 | 1.4 | 1.4 | 1.4 |
| Repulsion performance [index] | 100 | 103 | 105 | 95 | 98 | 98 | 98 | 100 | 100 |
| Durability [ball hitting number] | 15000 | 14500 | 12000 | 10000 | 8500 | 11700 | 12000 | 15000 | 14000 |
| Durability [broken position] | Face portion | face portion | crown portion | crown portion | crown portion | crown portion | crown portion | face portion | face portion |
| Ball hitting feeling [five point method] | 3.9 | 4.1 | 4.5 | 3.1 | 3.5 | 3.6 | 3.7 | 3.9 | 3.7 |

From the test results, it was confirmed that the repulsion performance, durability and hitting feeling can be improved.

The invention claimed is:

1. A hollow golf club head comprising a face portion whose front face defines a club face for striking a golf ball, a crown portion intersecting the club face at the upper edge thereof, and a sole portion intersecting the club face at the lower edge thereof, wherein at least a part of the crown portion or at least a part of the sole portion is made of a rolled steel, and a rolling direction of the rolled steel is in the range of from 0 to 20 degrees with respect to a front-back direction of the head.

2. The golf club head according to claim 1, wherein the club head comprises a head main body formed by casting a metallic material and being provided with an opening on the crown portion, and a crown plate made of the rolled steel and being attached to the head main body so as to close the opening of the crown portion.

3. The golf club head according to claim 2, wherein the rolled steel has a thickness in the range of from 0.3 to 0.9 mm.

4. The golf club head according to claim 2, wherein the crown plate comprises a center portion and a peripheral portion surrounding the center portion, and the center portion has a thickness smaller than the peripheral portion.

5. The golf club head according to claim 4, wherein a thickness of the peripheral portion is in the range of from 0.4 mm to 0.9 mm, and a thickness of the center portion is in the range of from 0.3 mm to 0.6 mm.

6. The golf club head according to claim 2, wherein the head main body has a crown edge portion surrounding the opening in the crown portion, and the crown edge portion has the same thickness with the peripheral portion of the crown plate.

* * * * *